US009279347B2

(12) United States Patent
Gaia et al.

(10) Patent No.: US 9,279,347 B2
(45) Date of Patent: Mar. 8, 2016

(54) HIGH TEMPERATURE ORC SYSTEM

(75) Inventors: Mario Gaia, Brescia (IT); Roberto Bini, Brescia (IT); Claudio Pietra, Brescia (IT)

(73) Assignee: TURBODEN S.R.L., Brescia (IT)

( * ) Notice: Subject to any disclaimer, the term of this patent is extended or adjusted under 35 U.S.C. 154(b) by 334 days.

(21) Appl. No.: 13/696,074

(22) PCT Filed: May 5, 2011

(86) PCT No.: PCT/IT2011/000140
§ 371 (c)(1),
(2), (4) Date: Nov. 4, 2012

(87) PCT Pub. No.: WO2011/141942
PCT Pub. Date: Nov. 17, 2011

(65) Prior Publication Data

US 2013/0047614 A1 Feb. 28, 2013

(30) Foreign Application Priority Data

May 13, 2010 (IT) ..... BS2010A0095

(51) Int. Cl.

| | |
|---|---|
| ***F01K 7/34*** | (2006.01) |
| ***F01K 25/08*** | (2006.01) |
| ***F01K 23/04*** | (2006.01) |
| ***F01K 23/06*** | (2006.01) |

(Continued)

(52) U.S. Cl.
CPC . *F01K 25/08* (2013.01); *F01K 7/22* (2013.01); *F01K 7/40* (2013.01)

(58) Field of Classification Search
CPC ..... F01K 7/40; F01K 7/42; F01K 7/44; F01K 19/00; F01K 19/02; F01K 19/04; F01K 19/06; F01K 19/08; F01K 9/003; F01K 13/00; F01K 23/08; F01K 17/02; F01K 7/22; F01K 7/34; F01K 23/04; F01K 23/06; F01K 25/08; F22B 1/006; Y02E 10/46; Y02E 20/14
USPC ..... 60/651, 653, 655, 670, 671; 290/2
See application file for complete search history.

(56) References Cited

U.S. PATENT DOCUMENTS 4,503,682 A * 3/1985 Rosenblatt ..... 60/671
5,867,988 A * 2/1999 Kaplan ..... 60/651

(Continued)

FOREIGN PATENT DOCUMENTS

CA 2481522 A1 4/2006
DE 3616797 A1 11/1987

(Continued)

*Primary Examiner* — Jorge Pereiro
*Assistant Examiner* — Daniel Wagnitz
(74) *Attorney, Agent, or Firm* — Lucas & Mercanti, LLP

(57) ABSTRACT

The invention relates to an ORC (Organic Rankine Cycle) for the conversion of thermal energy into electric energy, comprising at least one heat exchanger unit for re-superheating the working fluid by means of the thermovector fluid from the hot source, between the discharge of the first expander and the input of the second expander, and a regenerator unit including a first regenerator and at least one second regenerator for regenerating the working fluid in at least two successive stages, in said first regenerator and at least in said second regenerator respectively, with an additional regenerative heat exchange along the flow line connecting the liquid working fluid output of the second regenerator to the liquid working fluid input of the first regenerator.

14 Claims, 6 Drawing Sheets

(51) Int. Cl.
*F01K 7/22* (2006.01)
*F01K 7/40* (2006.01)

(56) References Cited

U.S. PATENT DOCUMENTS

| | | | | |
|---|---|---|---|---|
| 7,040,095 | B1 * | 5/2006 | Lang | 60/653 |
| 2003/0213248 | A1 * | 11/2003 | Osborne et al. | 60/670 |
| 2006/0254251 | A1 | 11/2006 | Yamada | |
| 2009/0188253 | A1 * | 7/2009 | Smith et al. | 60/670 |
| 2010/0071368 | A1 * | 3/2010 | Kaplan et al. | 60/651 |
| 2012/0131920 | A1 * | 5/2012 | Held et al. | 60/650 |
| 2014/0026573 | A1 * | 1/2014 | Palmer | 60/671 |
| 2014/0026574 | A1 * | 1/2014 | Leibowitz et al. | 60/651 |
| 2014/0075941 | A1 * | 3/2014 | Adachi et al. | 60/670 |

FOREIGN PATENT DOCUMENTS

| | | | | |
|---|---|---|---|---|
| EP | 1519108 | A1 | 3/2005 | |
| WO | 98/15721 | A1 | 4/1998 | |
| WO | WO 2010122591 | A1 * | 10/2010 | F22B 3/04 |

* cited by examiner

FIG. 6
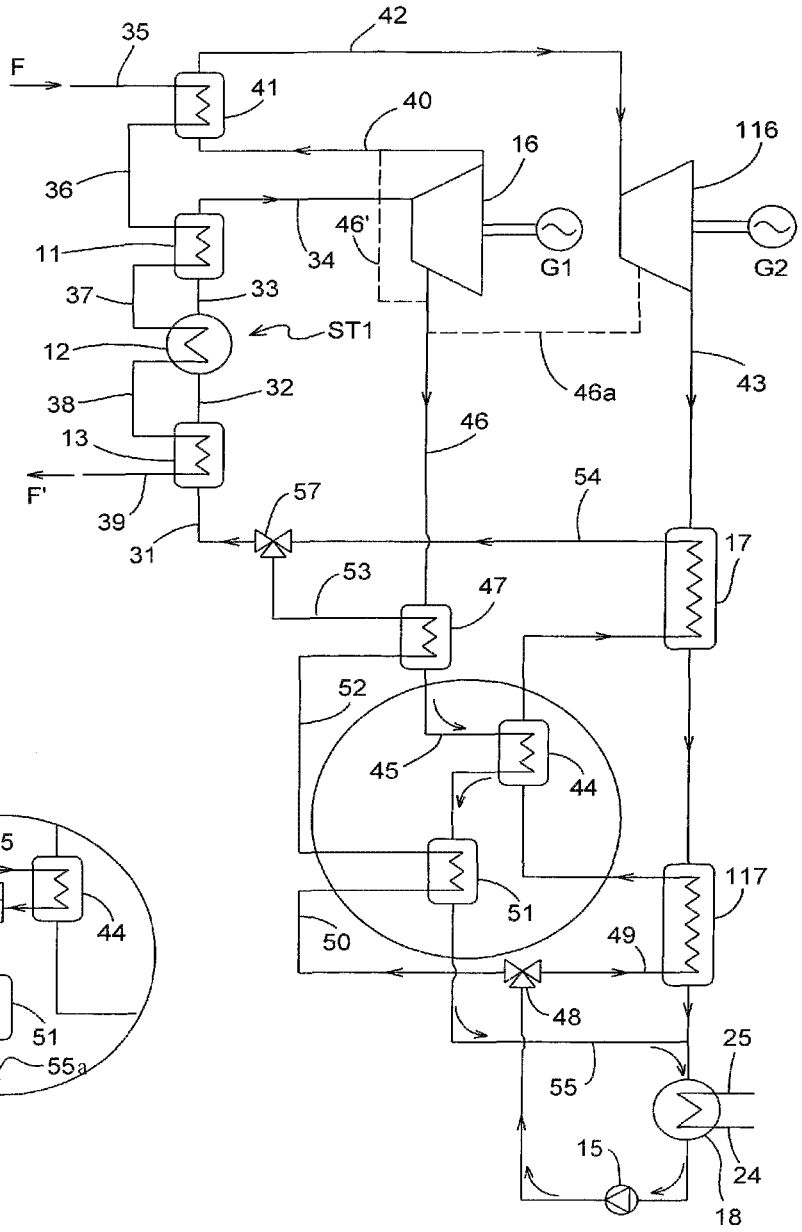
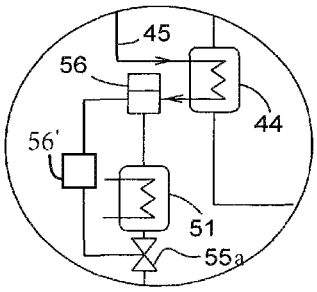
FIG. 7

HIGH TEMPERATURE ORC SYSTEM

CROSS-REFERENCE TO RELATED APPLICATIONS

This application is a 371 of PCT/IT2011/000140, filed May 5, 2011, which claims the benefit of Italian Patent Application No. BS2010A000095, filed May 13, 2010, the entire contents of each of which are incorporated herein by reference.

FIELD OF THE INVENTION

The present invention relates to systems for the conversion of thermal energy into electric energy by means of a so-called ORC (Organic Rankine Cycle), where the temperature of the hot source is high and therefore, in order to make full use thereof, it is preferable to employ a Rankine power cycle operated at both an evaporation, or transition, temperature of the working fluid from liquid-to-gaseous and a maximum cycle temperature that are as high as possible, compatible with the thermal stability of the working fluid.

BACKGROUND OF THE INVENTION

In the cases considered herein, the maximum temperatures in an ORC system are typically in the range from 330 to 380° C., although lower or higher temperatures are possible depending on the working fluid used in each individual case, such as a silicone oil, an aromatic hydrocarbon or the like.

The minimum temperature of the Rankine cycle depends on the cold source available to condense the working fluid. In the discussion that follows, mention will be made, for example, to a cold source in the form of cooling water which can be made available by a cooling tower, thus having a minimum temperature of around 25 to 30° C. and a flow rate such as to reach a typical temperature increase of around 10° C. on extracting heat from the cycle. However, the following considerations also apply to different cold sources, provided that the temperature difference between the maximum temperature of the available hot source and the maximum temperature of the cold source is high, say above 300° C.

FIG. 1 of the accompanying drawings shows a typical arrangement of an ORC system 100 adapted for the above-mentioned conditions and basically comprising:

a thermal source S1 for heating a vector fluid;

a primary circuit 10 in which flows the vector fluid coming from and returning to the thermal source S1 in the direction of the arrow F, F', circulating by means of at least one recirculation pump—not shown in the Figure;

a heat exchange group ST1 which can include a superheater 11, an evaporator 12 and a pre-heater 13 for the exchange of heat between the vector fluid and a working fluid circulating in a relative circuit 14 by means of at least one relative pump 15;

an expander 16, typically composed of a turbine assembly, fed by the working fluid in output from the heat exchange unit and usually followed by a regenerator 17 and a condenser assembly 18.

In an ORC system as shown in FIG. 2 on the Entropy (S)-Temperature (T) thermodynamic plane, the points indicated, which correspond to the same points in the layout diagram in FIG. 1 also, have the following meaning:

1. pump (15) input;
2. pump (15) output and start of regeneration;
3. end of regeneration (17, liquid side);

4. end of pre-heating (13);
5. end of evaporation (12);
6. end of superheating (11)/expander (16) input;
7. expander (16) output/regenerator (17, vapour side) input;
8. regenerator (17) output/condenser (18) input; and
9. start of condensation.

FIG. 3 shows the heat exchange diagrams for the exchangers introducing and extracting heat, respectively from the hot source (line 10, 11, 12, 13)—i.e. with respect to the heat exchange unit 11-13 and towards the cold source (line 14,15), i.e. the condenser 18.

Then, FIG. 4 shows a diagram related to the thermal exchange within the cycle, which occurs in the regenerator component. The thermal exchange phenomena are shown on the Power Exchanged (Q)—Temperature (T) plane.

The fact that the maximum and minimum temperatures of the cycle differ considerably from each other as a result of the great difference between the temperatures of the sources, ensures that the amount of thermal energy for each mass unit of fluid flowing through the machine, and that has to be exchanged in the regenerator, is very high. For many fluids, the ratio between the thermal energy exchanged at the regenerator and the energy entering from the external hot source is greater than one unit. Furthermore, the difference in thermal capacity between the liquid branch and the vapour branch of the regenerator is also considerable, albeit to a different extent depending on the working fluid used.

Consequently, even when a regenerator with a high thermal exchange capacity is used, i.e. a regenerator with a large surface area, in which the product of the exchange surface area and the thermal exchange coefficient is such as to result in a modest temperature difference between liquid and gaseous form on the lower-temperature side of the regenerator, on the other side of the regenerator the difference in temperature remains considerably greater.

By way of example, a modest value in the difference in temperature on the cold side of the regenerator, $\Delta TF = T8 - T2$ (FIG. 4), can typically be quantified as 15° C., while on the other side of the regenerator, the difference $\Delta TC = T7 - T3$ is 2 or 3 times greater.

In order to avoid this problem, the solution of drawing off part of the flow rate from the liquid branch is adopted, the drawn-off flow rate being heated up to a temperature close to the end-of-regeneration temperature of the remaining flow rate by means of an external thermal source. This solution, sometimes referred to in the art as "splitting", is particularly advantageous when a thermal source is available that is characterized by a lower temperature than the main source.

However, there are systems where, apart from the main source, no high-temperature source is present or available, and the cold source is characterized by a relatively low temperature.

For example, this is the case of a system as schematically illustrated in FIG. 5, in which the only hot source available is a thermovector fluid which is heated in a bank of cylindrical-parabolic solar collectors 20 and which is supplied to the ORC system 100 via a feed conduit 21 and a return conduit 22 from/to the bank of collectors 20, possibly in the presence of a heat storage system 23 made according to known techniques.

As a cold source, the ORC system 100 uses a water flow supplied by a feed conduit 24 and a return conduit 25 from a cooling tower 26. In this example, the hot thermovector fluid may be a diathermic oil, i.e. a molten salt.

Nowadays, in several systems with a bank of cylindrical-parabolic collectors supplying systems that use the Rankine cycle with water vapour, rather than systems that use an organic fluid as working fluid, the thermovector fluid comprises a mixture of diphenyl and diphenyl oxide known under the trade name "Therminol VP1".

SUMMARY OF THE INVENTION

The present invention is aimed at maximising the efficiency of an ORC system precisely in those cases in which an auxiliary hot source is not available, the temperatures characterizing the available hot source are high, and the temperatures characterizing the cold source are much lower than those of the hot source.

The object of the invention is achieved by an ORC system according to the preamble of claim 1, which includes at least one heat exchange unit for re-superheating the working fluid by means of a thermovector fluid from the hot source, between the discharge of the first expander and the input of the second expander, and in which the regenerator group comprises a first regenerator and at least one second regenerator for regenerating the working fluid in at least two subsequent stages, respectively in said first regenerator and at least in said second regenerator, through an additional regenerative heat exchange along a flow line connecting a liquid fluid output of the second regenerator with a liquid fluid input of the first regenerator.

Advantageously, between the first regenerator and the second regenerator, at least one heat exchanger is inserted for exchanging heat between a fraction of the gaseous working fluid drawn off on a level of at least one of said expanders and the flow of liquid fluid from the output of the second regenerator towards the first regenerator. In order to re-superheat the working fluid according to the invention, a heat exchanger is provided comprising at least one exchanger/superheater inserted in the circuit of the thermovector fluid upstream of said heat exchanger unit and connected, on the working fluid side, in input to the discharge of the first expander and in output to the input of the second expander.

Preferably, in the system according to the invention, a mixture containing diphenyl and diphenyl oxide is used as a thermovector fluid, and a cyclic hydrocarbon, i.e. an aromatic hydrocarbon, i.e. toluene, xylene or the like is used as a working fluid.

BRIEF DESCRIPTION OF THE DRAWINGS

However, the invention will be better understood from the following description, based on FIGS. 1 to 5 as previously described in relation to the state of the art, and from the additional accompanying drawings, in which:

FIG. 6 shows a diagram of an ORC system comprising a unit for re-superheating the working fluid between a first and a second expander, and a regenerator system, in two successive stages according to the invention;

FIG. 7 shows a variation of part of the regenerative system as circled in FIG. 6;

In these further drawings, where applicable, the same reference numerals are used to indicate parts or components that are the same or similar to those shown in FIG. 1, but in any case omitting valves, pumps and those ordinary accessories that usually complete an ORC system and ensure its operation.

DETAILED DESCRIPTION OF THE INVENTION

Figure 1:
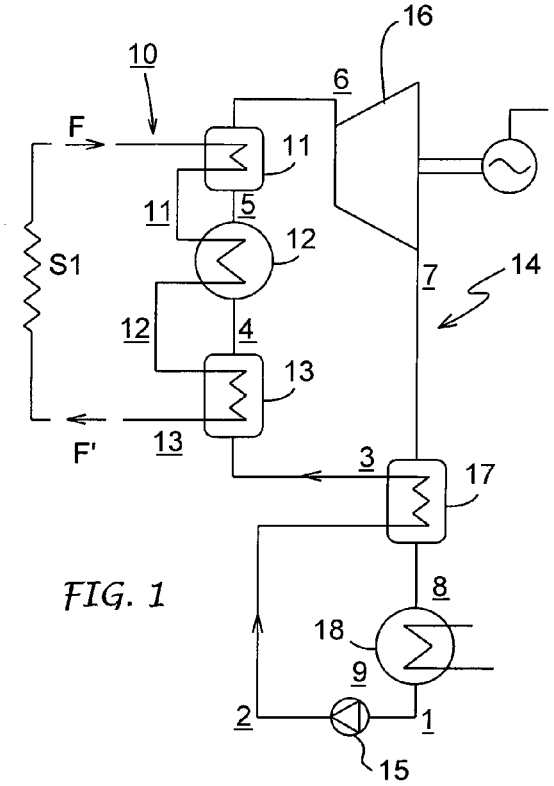
FIG. 1 shows a typical arrangement of an ORC system according to the state of the art.
Figure 2:
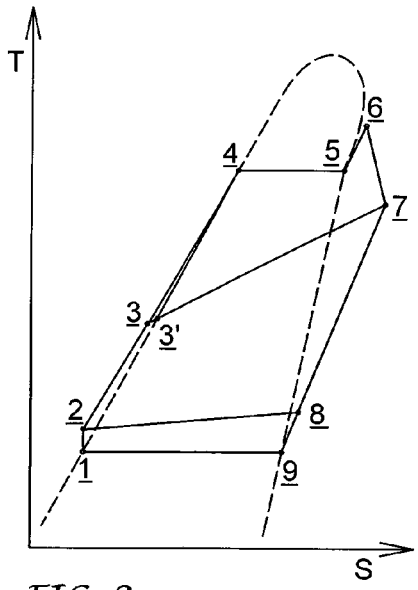
FIG. 2 shows a diagram on the Entropy (S)-Temperature (T) thermodynamic plane of an ORC system according to the state of the art.
Figure 3:
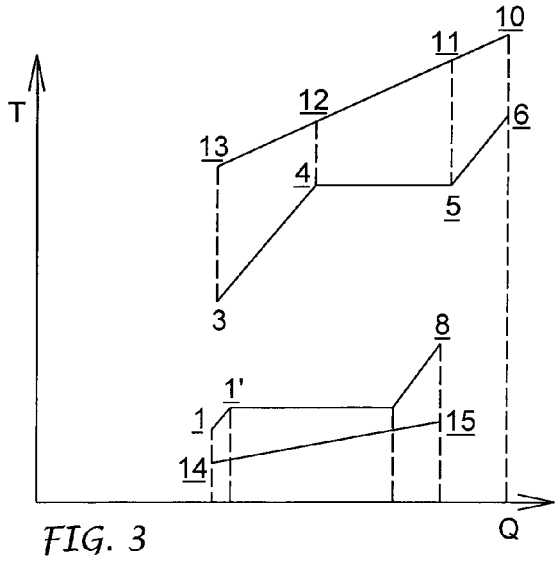
FIG. 3 shows a heat exchange diagrams of an ORC system according to the state of the art.
Figure 4:
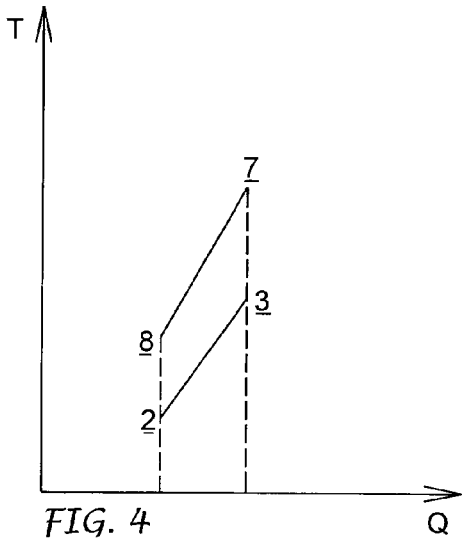
FIG. 4 shows a diagram on the Power Exchanged (Q)—Temperature (T) plane of an ORC system according to the state of the art.
Figure 5:
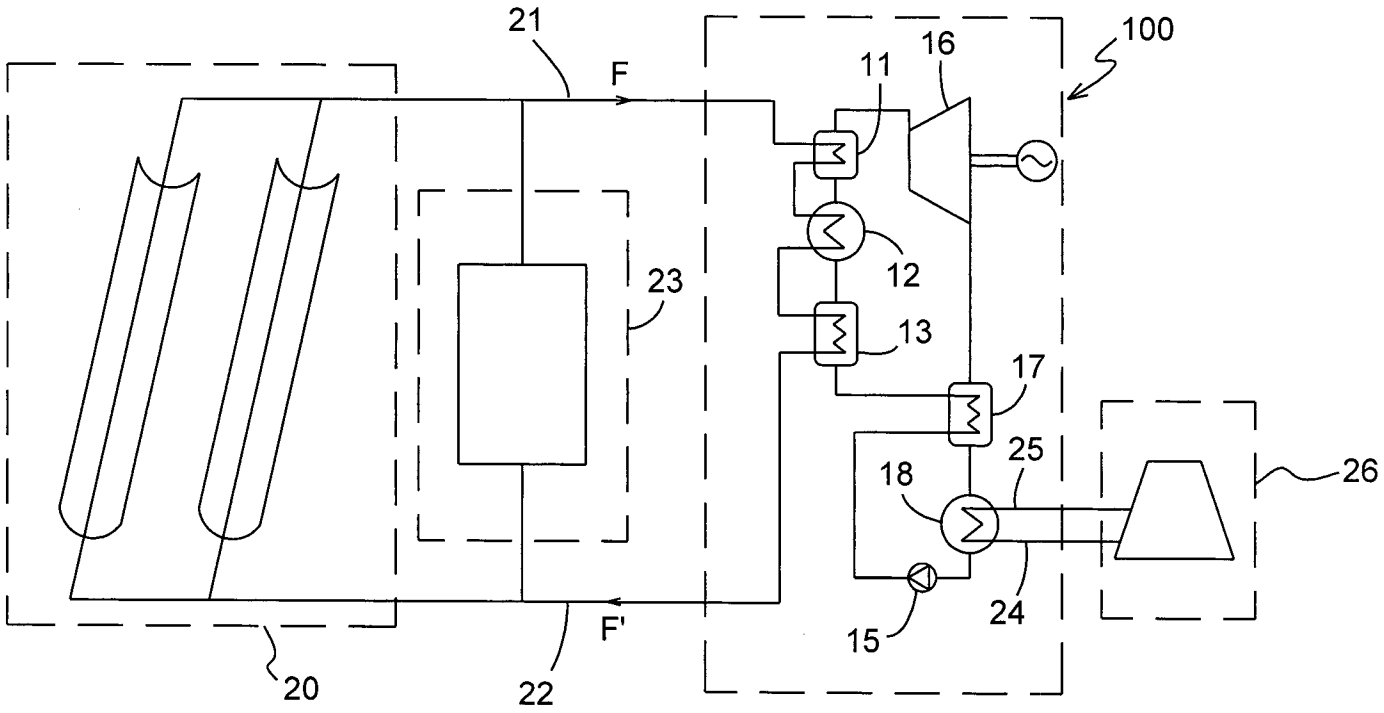
FIG. 5 shows an example of an ORC system according to the state of the art having only one hot source available corresponding to a thermovector fluid which is heated in a bank of cylindrical—parabolic solar collectors.

An embodiment of a new organic-fluid Rankine Cycle, provided with solutions capable of increasing the efficiency of conversion of thermal energy into electric energy, is shown in FIG. 6. It comprises, in a known way, a heat exchange unit ST1 between the hot source and the working fluid, where the hot source is composed, for example, of a flow of diathermic oil or a mixture of fluids, conveyed in the circuit 10 in the direction of arrows F-F' and resistant to high temperatures, while the organic working fluid is composed, for example, of an aromatic hydrocarbon such as toluene or xylene.

In this heat exchange unit, the working fluid runs sequentially through conduits 31, 32, 33, 34 and the exchangers; respectively: the liquid pre-heater 13, the evaporator 12 and the superheater 11.

On the other hand, the vector fluid from the hot source runs sequentially through the above-described exchangers, passing through the successive conduits 35, 36, 37, 38, 39.

The superheated working fluid exiting the superheater 11 of the heat exchange unit ST1 is expanded in a first high-pressure expander or turbine 16, from the input conditions existing at the conduit 34 to the conditions existing at the output 40, by the expander 16 itself.

Next, according to one aspect of the invention, the working fluid is fed through the output conduit 40 to an additional exchanger/superheater 41 located downstream of the superheater 12 of the heat exchange unit ST1. In the additional exchanger/superheater 41, the working fluid is re-superheated by the vector fluid from the hot source, to a temperature close to, or preferably higher than the temperature of the fluid in the conduit 34.

The working fluid then exits the additional exchanger/superheater 41 via a conduit 42, through which it is fed and expanded into an additional low-pressure expander or turbine 116, having an discharge conduit 43 through which the working fluid then enters the regenerator 17.

The two expanders or turbines 16, 116 operate electric generators G1, G2, respectively, preferably each at a different rotational speed. To be precise, the rotational speed of the shaft of generator G1 connected to the first expander 16 will be greater than that of generator G2 connected to the other expander 116, so as to exploit efficiently the expansion of the high-pressure fluid, which may itself have a lower volumetric flow rate than the fluid fed into the other low-pressure expander 116.

When necessary for determining the correct size of the blades, the shaft of generator G1 will be able to rotate at a slower speed than the respective expander 16 by interposing a speed reduction unit—not shown in the Figure.

According to another aspect of the invention, a second regenerator 117 is located downstream of the regenerator 17 in the path of the organic working fluid vapour, but in such a way that, for all intents and purposes, the sum of the two used regenerators 17, 117 is approximately equivalent, in terms of extension, size and loss of load, to one regenerator of a traditional regenerative cycle such as that shown in FIG. 1.

The regeneration of the working fluid then occurs in two successive stages: partly in the first regenerator and partly in the second regenerator, in other words, by interrupting the normal regeneration in the first regenerator in order to resume and complete it in the downstream regenerator 117.

The flow rate of liquid exiting the second regenerator 117 is sent back to the first regenerator 17, not directly but through a heat exchanger 44. This heat exchanger 44 substantially serves as a condenser for a flow rate of working fluid 45—in the vapour phase—that can be drawn from an intermediate part of the first high-pressure expander 16 by means of a conduit 46, and/or from the discharge conduit 40 through a line 46'. Hence, the flow rate of working fluid thus drawn off will be able to have then a pressure greater than, or equal to, that at the discharge 40 of said first expander. Note also that the working fluid in the vapour phase could be drawn off, apart from the first expander, also from an intermediate point of the second expander 116 along the line 46*a* in FIG. 6.

The working fluid vapour thus drawn off passes into conduit 46 and, before reaching the exchanger 44, is however de-superheated in a heat exchanger 47. This results in heating of a portion of liquid working fluid which is extracted, by means of a three-way valve 48, from the flow 49 downstream of the feed pump 15 and sent, through the conduit 50, for a first heating in an exchanger 51 at the expense of the sensible heat of the liquid fluid resulting from the condensation in the exchanger 44 of the flow rate fed through the conduit 45, and for a second heating from the conditions of the line 52 to the conditions of the line 53 in the exchanger 47. On completed heating, the flow rate of fluid in line 53 has a temperature close to that of the flow rate 54 and the two flows are conveyed, through a valve 57, into conduit 31 and then towards the heat exchange unit ST1.

The flow rate of fluid in line 55 exiting the exchanger 51 is sent to the condenser 18 and it is preferably cooled by a flow of water (or other fluid capable of extracting heat, such as ambient air) supplied through the feed conduit 24 and returned through conduit 25. The circuit is completed by pump 15 receiving the liquid from the condenser 18 and sending it to the high-pressure part of the circuit that performs the cycle.

Fig, 7 shows a possible circuit arrangement for the exchanger 44, where it is shown that, as a fluid condenser 45 is involved, it may be advantageous to provide its discharge with a container 56 (possibly incorporated into the exchanger 51) provided with a level control means 56' that operates a throttle valve 55a acting as a condensate downloader, so that only the liquid fraction is sent to the exchanger 51.

Figure 8:
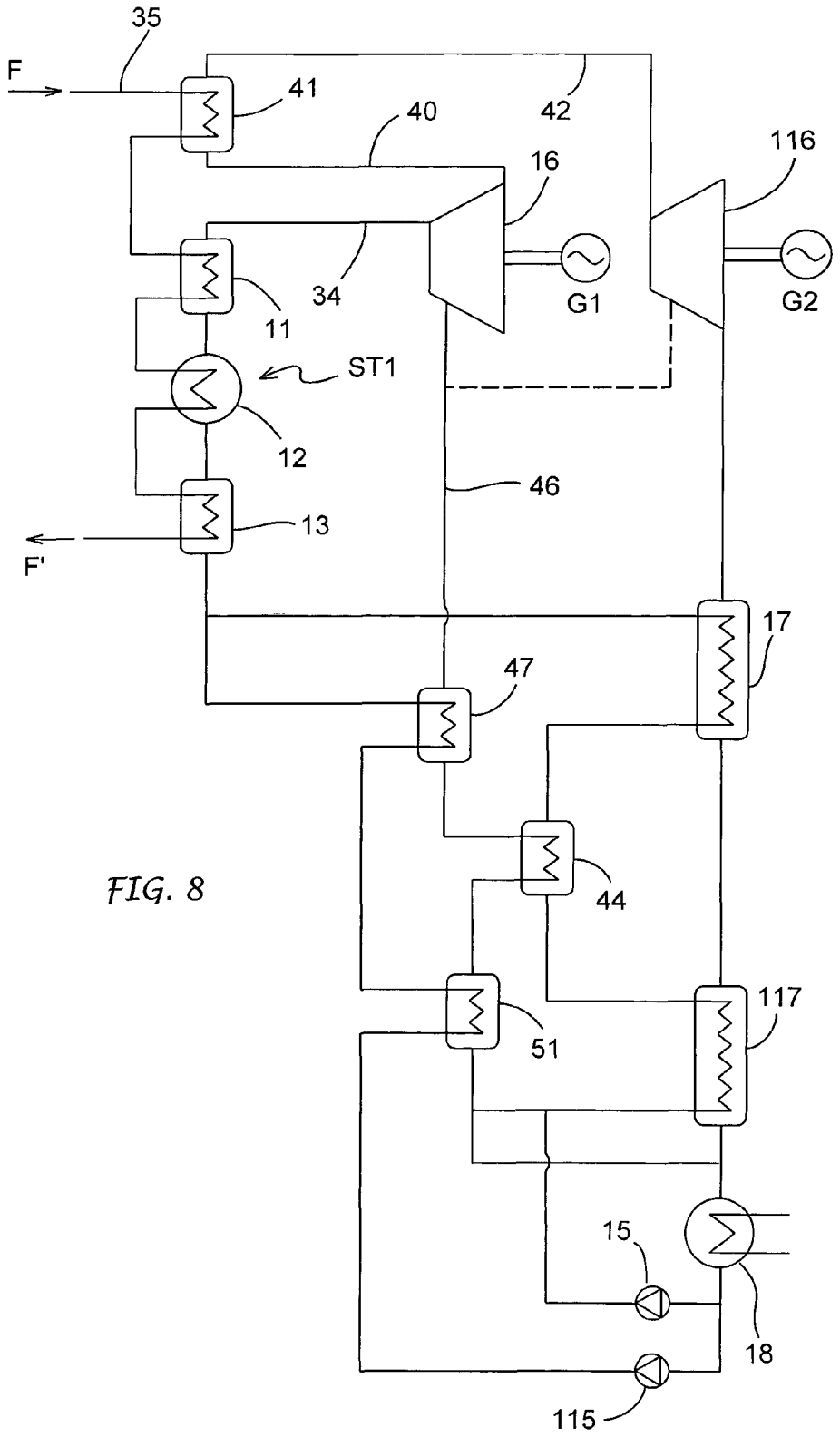
FIG. 8 shows a diagram of a variation of the ORC system in FIG. 6.

A possible alternative to the embodiment of the invention is shown in FIG. 8. Here, the flow rate extracted at the liquid branch of the regenerator is propelled by a second feed pump 115 instead of being selected by the valve 48 shown in FIG. 6.

Moreover, the flow rate dosing function can also be achieved by means of the valve 57 in FIG. 6, instead of the valve 48.

Therefore, the circuit described also includes, alongside the re-superheating in the expansion stage of the working fluid vapour between the first turbine 16 and the second turbine 116, a regeneration of the working fluid characterized by having an exchange of heat with the main flow of liquid which is limited solely to the condensation of the heating fluid. In this way it is possible to obtain an exchange of heat in the exchangers 51, 47 with minimum differences in temperature, and therefore with a generation of entropy in these components which is as small as possible, thereby favourably affecting the cycle efficiency.

Figure 9:
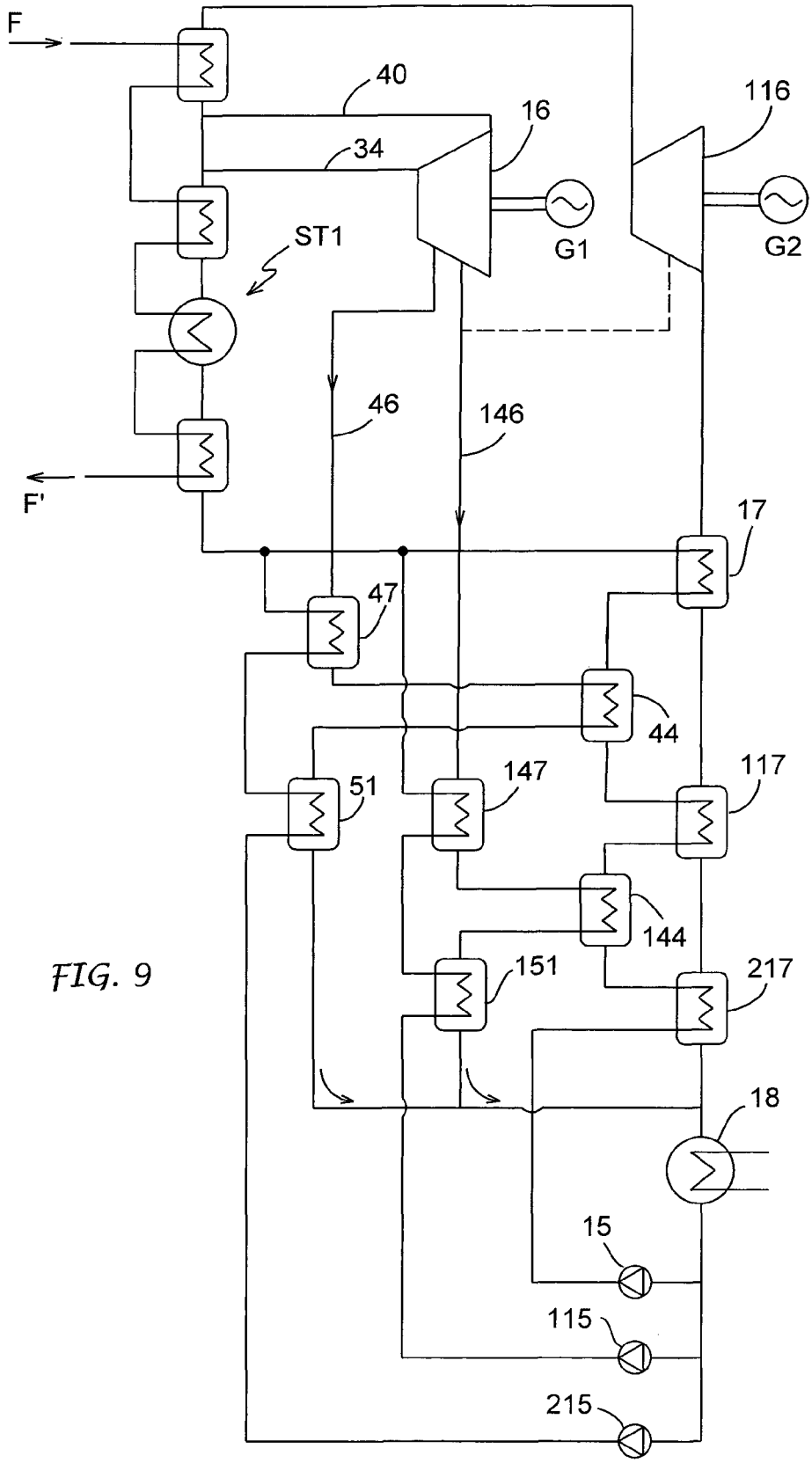
FIG. 9 shows a diagram of a variation of the ORC system in FIG. 8.
Figure 10:
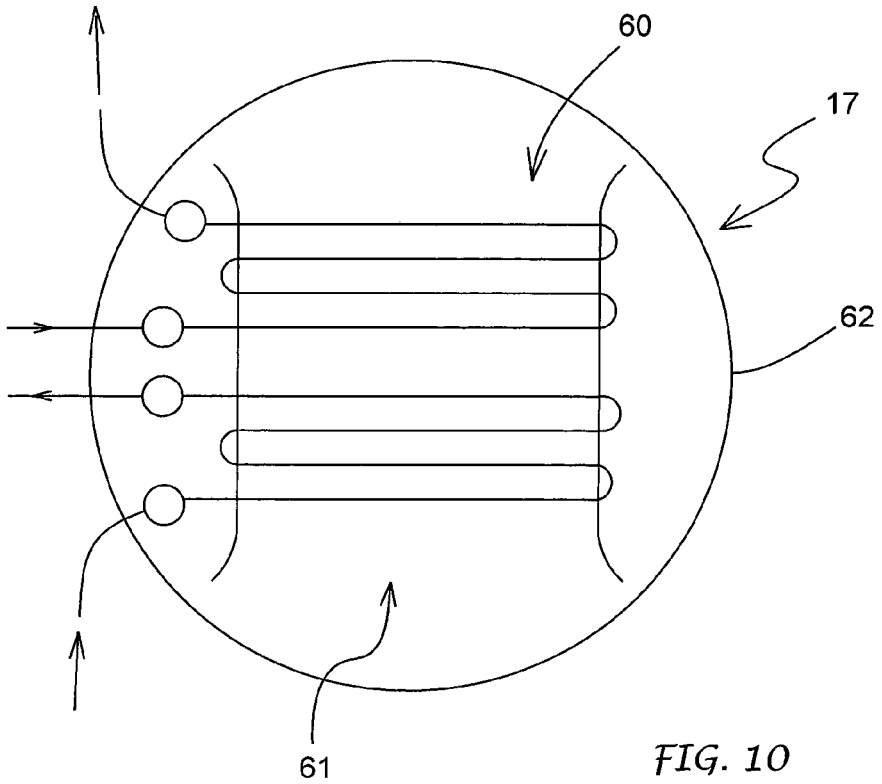
FIG. 10 shows a possible configuration of the collectors drawing off and returning the liquid to the first regenerator.

For the case of separate pumps, FIG. 9 represents an arrangement that performs the same procedure of localized heating of the liquid passing through the regenerator, but repeated twice, with different levels of condensation pressure. Here, two different positions of bleeding the fluid from the first high-pressure expander 16 are contemplated, which is performed, in addition to through the line 46 and/or from the discharge conduit 40, as previously described, also through a second bleeding line 146. Furthermore, in association with the first regenerator 17, between this and condenser 18 downstream, there are provided a second 117 and a third 217 regenerator with associated respective heat exchangers 44, 47, 51, respectively 144, 147, 151, and a circulation pump, respectively 15, 115, 215, similar to the arrangement shown in FIG. 8. FIG. 10 shows a possible configuration of the collectors 60, 61, respectively for drawing off and returning the liquid to the regenerator 17, 117, in an integrated form inside the casing 62 of the same regenerator.

The invention claimed is:

1. An ORC system (Organic Rankine Cycle) for the conversion of thermal energy into electric energy, comprising:

a thermovector fluid, a thermal heating source for heating the thermovector fluid, a primary circuit in which flows a thermovector fluid coming from said thermal source, a working fluid, a related second fluid circuit wherein the working fluid circulates in the related second fluid circuit, at least one relative pump wherein the working fluid circulates by means of the relative pump, a heat exchange group for the exchange of heat between the thermovector fluid and the working fluid, a first expander having an input and an output, wherein the working fluid from said heat exchange group is fed to the first expander through the input, a first electric generator connected to the first expander, a second expander having an inlet and an outlet, wherein the working fluid from the output of the first expander is fed to the second expander through the inlet, a second electric generator connected to the second expander, a conduit of the working fluid in a gaseous form connected to the outlet of said second expander, a regenerator group disposed along the conduit of the working fluid connected to the outlet of said second expander, and a condenser connected to and located downstream of said regenerator group, wherein at least one heat exchanger unit of the heat exchanger group re-superheats the working fluid with the thermovector fluid coming from the thermal source, wherein the heat exchanger unit is located between the output of the first expander and the inlet of the second expander, and the regenerator group comprises at least a first regenerator, a second regenerator, a flow line connecting the first and second regenerators, and a heat exchanger disposed between the regenerators and along the flow line, wherein the working fluid flows in the flow line, each of the regenerators regenerates the working fluid, and the heat exchanger exchanges heat between a fraction of gaseous working fluid drawn from at least one of the expanders and a liquid working fluid flowing from the second regenerator toward the first regenerator.

2. An ORC system according to claim 1, wherein said heat exchange unit for the re-superheating of the working fluid comprises an exchanger/superheater disposed upstream of said heat exchanger group and in the primary circuit of the thermovector fluid, and wherein the exchanger/superheater is connected to the output of the first expander and the inlet of the second expander.

3. An ORC system according to claim 1, wherein the first electric generator rotates at a first rotational speed and the second electric generator rotates at a second rotational speed, and the first rotational speed is greater than the second rotational speed.

4. An ORC system according to claim 1, wherein means are provided for a control of the fraction of gaseous working fluid collected from at least one of said expanders and the liquid working fluid towards the heat exchanger positioned between the first regenerator and the second regenerator.

5. An ORC system according to claim 1, wherein the thermovector fluid is made up of a mixture containing biphenyl and biphenyl oxide and the working fluid is a cyclic hydrocarbon.

6. An ORC system according to claim 1, wherein the thermovector fluid is made up of a mixture containing biphenyl and biphenyl oxide and the working fluid is an aromatic hydrocarbon.

7. An ORC system according to claim 1, wherein the thermovector fluid is made up of a mixture containing biphenyl and biphenyl oxide and the working fluid is toluene.

8. An ORC system according to claim 1, further comprising a collecting conduit and a de-superheating exchanger, wherein the collecting conduit is provided for collecting a fraction of gaseous working fluid at least from the first expander, and the collecting conduit feeds the fraction to said heat exchanger via the de-superheating exchanger.

9. An ORC system according to claim 8, wherein the first expander further includes an intermediate part and said collecting conduit for collecting the fraction of gaseous working fluid is connected to the intermediate part or to the ouput of the first expander.

10. An ORC system according to claim 8, wherein the second expander further includes an intermediate part and said collecting conduit for collecting the fraction of gaseous working fluid is connected to the intermediate part of the second expander.

11. An ORC system according to claim 1, wherein one heat exchanger is provided for a first heating of the working fluid at the expense of the sensible heat of the exiting liquid working fluid in the heat exchanger positioned between the first regenerator and the second regenerator, a second heating of the same working fluid being carried out in the de-superheating exchanger of the gaseous working fluid deriving from one of the expanders.

12. An ORC system according to claim 11, further comprising a container provided with level control means and a throttle valve, wherein the level control means control the throttle valve, and wherein the heat exchanger positioned between the first regenerator and the second regenerator and the heat exchanger for the first heating of the working fluid at the expense of the sensible heat of the liquid working fluid are connected to the container.

13. A method for a conversion of thermal energy into electric energy using an ORC system according to claim 1, comprising:

re-superheating the working fluid between the output of the first expander and the inlet of the second expander, through an exchange of heat with the thermovector fluid coming from the thermal heating source, and exchanging heat between the fraction of gaseous working fluid collected from at least one of said expanders and the liquid working fluid flowing from the second regenerator toward the first regenerator.

14. A method according to claim 13, further comprising de-superheating the fraction of gaseous working fluid collected from at least one of said expanders prior to the exchanging heat between said fraction of gaseous working fluid and the liquid working fluid flowing from the second regenerator toward the first regenerator.

* * * * *